US005993682A

United States Patent [19]

Tapscott et al.

[11] Patent Number: 5,993,682

[45] Date of Patent: Nov. 30, 1999

[54] HYDROBROMOCARBON BLENDS TO PROTECT AGAINST FIRES AND EXPLOSIONS

[75] Inventors: Robert E. Tapscott; Ted A. Moore; Joseph L. Lifke, all of Albuquerque, N.Mex.

[73] Assignee: University of New Mexico, Albuquerque, N.Mex.

[21] Appl. No.: 08/926,158

[22] Filed: Sep. 9, 1997

Related U.S. Application Data

[60] Provisional application No. 60/025,969, Sep. 9, 1996.

[51] Int. Cl.[6] ..... A62D 1/08; A62C 2/00; A62C 3/02

[52] U.S. Cl. ..... 252/8; 252/2; 169/45; 169/46; 169/47

[58] Field of Search ..... 252/2, 8; 169/45, 169/46, 47

[56] References Cited

U.S. PATENT DOCUMENTS

| | | | |
|---|---|---|---|
| 2,569,979 | 10/1951 | Durfee et al. | 252/8 |
| 2,818,382 | 12/1957 | Rotival | 252/8 |
| 3,657,120 | 4/1972 | Porst | 252/8 |
| 5,102,557 | 4/1992 | Nimitz et al. | 252/8 |
| 5,124,053 | 6/1992 | Likubo et al. | 252/8 |
| 5,135,054 | 8/1992 | Nimitz et al. | 169/46 |
| 5,219,474 | 6/1993 | Song et al. | 252/8 |
| 5,718,293 | 2/1998 | Flynn et al. | 169/45 |
| 5,759,430 | 6/1998 | Tabscott et al. | 252/8 |

*Primary Examiner*—Joseph D. Anthony
*Attorney, Agent, or Firm*—Robert W. Becker & Associates

[57] ABSTRACT

A set of blends for extinguishment of fires, suppression of explosions, and inertion against fires and explosions is disclosed. The blends are comprised of a bromine-containing component and a fluorine-containing component. The bromine-containing component is comprised of one or more hydrobromoalkanes, hydrobromoalkenes, and/or hydrobromoarenes. The fluorine-containing component is comprised of one or more fluorine-containing halocarbons, which may also contain chlorine. Specifically provided as fluorine-containing halocarbons are saturated and unsaturated hydrochlorofluorocarbons, hydrofluorocarbons, perfluorocarbons, perfluoroethers, hydrofluoroethers, and/or hydrofluoropolyethers. This provides a blend that mimics the fire and explosion protection action of halons and hydrobromofluorocarbons without the environmental impact associated with these compounds, which contain bromine and fluorine in the same molecule.

12 Claims, 1 Drawing Sheet

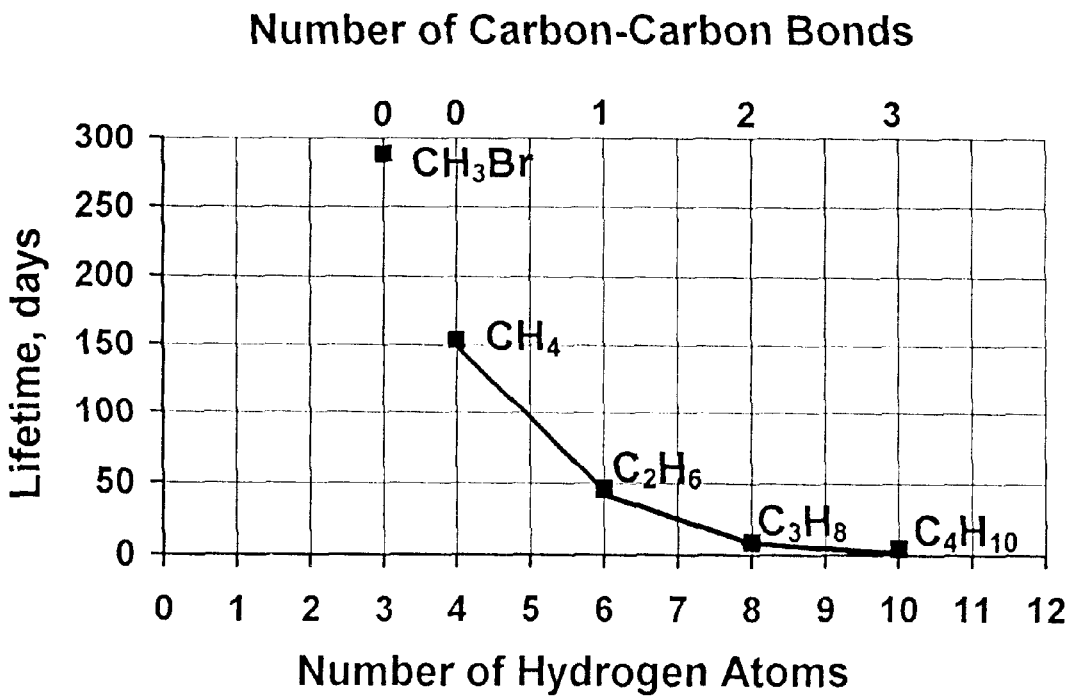
Figure 1. Atmospheric Lifetime as a Function of Number of Hydrogen Atoms.

HYDROBROMOCARBON BLENDS TO PROTECT AGAINST FIRES AND EXPLOSIONS

This application claims benefit of provisional application Ser. No. 60/025969 filed Sep. 9, 1996.

GOVERNMENT RIGHTS

This invention was made under contract with the U.S. Government, which has certain rights therein.

FIELD OF THE INVENTION

The invention described and claimed herein is generally related to chemical agents used for fire extinguishment, explosion suppression, explosion inertion, and fire inertion, and more particularly, to extinguishing, suppressing, and inerting blends of hydrobromoalkanes, hydrobromoalkenes, and hydrobromoarenes with fluorine-containing halocarbons to provide replacements for halon fire and explosion suppressants and extinguishants. The production of halons has been eliminated or curtailed due to their impact on stratospheric ozone.

BACKGROUND OF THE INVENTION AND PRIOR ART

The broad class of compounds termed "halocarbons" consists of all molecules containing carbon (C) and one or more of the atoms fluorine (F), chlorine (Cl), bromine (Br), and/or iodine (I). These four elements—fluorine, chlorine, bromine, and iodine—are members of the halogen family of elements. When defined in the broadest sense, as we do here, halocarbons may also contain other chemical features such as hydrogen atoms, carbon-to-carbon multiple bonds, aromatic rings, and ether linkages. Haloalkanes, a subset of halocarbons, contain only single bonds between the carbon atoms. Haloalkenes contain one or more double bonds connecting carbon atoms. Haloarenes contain aromatic groups based on the six-carbon benzene ring. Aromatic groups formally contain alternating single and double carbon to carbon bonds, but in actuality, the bonds are "delocalized" such that the carbon to carbon bonding is greater than single bonding but less than double bonding. Compounds that contain no multiple bonding, such as the alkanes, are said to be "saturated." Alkenes and arenes are said to be "unsaturated."

The use of certain haloalkanes as fire extinguishing agents has been known for many years. Fire extinguishers containing carbon tetrachloride ($CCl_4$, also known as tetrachloromethane) or methyl bromide ($CH_3Br$, also known as bromomethane) were used in aircraft applications as early as the 1920s (Charles L. Ford, "An Overview of Halon 1301 Systems," in *Halogenated Fire Suppressants,* Richard G. Gann, editor, ACS Symposium Series 16, American Chemical Society, Washington, D.C., 1975). Over a period of years, the high toxicity of these compounds was recognized and they were replaced with less toxic materials, in particular bromofluoroalkanes and closely related compounds. A major study of haloalkanes as fire extinguishing agents was conducted by the Purdue Research Foundation for the U.S. Army from 1947 to 1950 (*Fire Extinguishing Agents,* Final Report, Purdue University, 1950. A synopsis of the results from this study is available in Ford, op. cit.).

The term "extinguishment" is usually used to denote complete elimination of a fire; whereas, "suppression" is often used to denote reduction, but not necessarily total elimination, of a fire or explosion. These two terms are sometimes used interchangeably. There are four general types of halocarbon fire and explosion protection applications. (1) In total-flood fire extinguishment and/or suppression applications, the agent is discharged into a space to achieve a concentration sufficient to extinguish or suppress an existing fire. This is often, though not always, done by an automatic system, which detects the fire and then automatically discharges the extinguishing agent to fill the space with the concentration of a gaseous or an evaporated volatile liquid agent to the concentration needed to suppress or extinguish the contained fire. Total flooding use includes protection of enclosed, potentially occupied spaces such as computer rooms as well as specialized, often unoccupied spaces such as aircraft engine nacelles and engine compartments in vehicles. Note that the term "total flood" does not necessarily mean that the extinguishing or suppressing agent is uniformly dispersed throughout the space protected. (2) In streaming applications, the agent is applied directly onto a fire or into the region of a fire. This is usually accomplished using manually operated wheeled or portable fire extinguishers. A second method, which we have chosen to include as a streaming application, uses a "localized" system, which discharges agent toward a fire from one or more fixed nozzles. Localized systems may be activated either manually or automatically. (3) In explosion suppression, an agent is discharged to suppress an explosion that has already been initiated. The term "suppression" is normally used in this application since an explosion is usually self-limiting. However, the use of this term does not necessarily imply that the explosion is not extinguished by the agent. In this application, a detector is usually used to detect an expanding fireball from an explosion, and the agent is discharged rapidly to suppress the explosion. Explosion suppression is used primarily, but not solely, in military applications. (4) In inertion, an agent is discharged into a space to prevent an explosion or a fire from being initiated. Often, a system similar or identical to that used for total-flood fire extinguishment or suppression is used. Inertion is widely used for protection of oil production facilities at the North Slope of Alaska and in other areas where flammable gases or explosive dusts may build up. Usually, the presence of a dangerous condition (for example, dangerous concentrations of flammable or explosive gases) is detected, and the agent is then discharged to prevent the explosion or fire from occurring until the condition can be remedied.

Thus, there are four fire and explosion protection applications covered by this disclosure:

1. Total-Flood Fire Extinguishment and Suppression
2. Streaming Fire Extinguishment and Suppression
3. Explosion Suppression
4. Explosion and Fire Inertion The cup burner is a widely accepted laboratory test apparatus for determining the fire extinguishing and suppressing effectiveness of agents. In this method, an agent is introduced into a stream of air which passes around a cup of burning liquid fuel, and the concentration of gaseous agent needed to extinguish the flame is determined. During this operation, any agent that is normally a liquid is allowed to become a gas before being mixed into the stream of air and passed by the burning liquid fuel. The cup burner is so widely accepted that the National Fire Protection Association (NFPA) Standard 2001 on Clean Agent Fire Extinguishing Systems mandates this method as the primary procedure for determining the concentration needed to extinguish a fire of liquid hydrocarbon fuels (e.g., gasoline, hexane, etc.; such fires are termed "Class B fires"). That standard states that "The minimum design concentration for Class B flammable liquids shall be a demonstrated extinguishing concentration plus a 20 percent safety factor. Extinguishing concentration shall be demonstrated by the cup burner test." Concentrations are usually expressed as "percent by volume." This is the same as the "percent by gas volume," which is calculated assuming that all of the introduced agent has volatilized (i.e., vaporized to become a gas).

The halocarbons most widely used for fire extinguishment (by total flooding or streaming), explosion suppression, explosion inertion, and fire inertion have been the three compounds shown in Table I. These materials are all alkanes containing both bromine and fluorine. To avoid the use of complicated chemical names, these (and other halocarbons used for fire and explosion protection) are often designated by a "Halon Number." Usually the word "Halon" is capitalized when used as part of a halon number, but is not capitalized when used generically for haloalkanes employed in fire and explosion protection. In recent years and, in particular, in regulatory documents, the term "halon" has been increasingly applied to denote the specific, widely used halocarbon agents shown in Table I and this is a practice that we use here. The "CAS No." is the number assigned by the Chemical Abstract Services of the American Chemical Society to aid in identifying chemical compounds. Halon 1301 has been widely used for total-flood fire extinguishment, explosion suppression, and inertion. Due to its higher boiling point and higher toxicity, Halon 1211 is most often used in streaming. Halon 2402 has had significant use in Eastern Europe for both total-flood and streaming, but has had relatively little use in other parts of the world.

TABLE I

HALONS USED IN FIRE AND EXPLOSION PROTECTION

| Name | Formula | Halon No. | CAS No. | ODP |
|---|---|---|---|---|
| bromotrifluoromethane | $CBrF_3$ | 1301 | 75-63-8 | 10 |
| bromochlorodifluoromethane | $CBrClF_2$ | 1211 | 353-59-3 | 3 |
| 1,2-dibromotetrafluoroethane | $CBrF_2CBrF_2$ | 2402 | 124-73-2 | 6 |

Bromine-containing compounds such as the halons are believed to operate as fire extinguishing agents by a complex chemical reaction mechanism involving the disruption of free-radical chain reactions, which are essential for continued combustion. Bromine is much more effective than chlorine or fluorine in promoting this disruption. In fact, there is doubt that chlorine or, in particular, fluorine plays a significant role in free-radical reaction disruption. The fluorine-containing portion of the halon molecules may, however, provide significant cooling and may thereby enhance extinguishment by the bromine. The halons are desirable as fire extinguishing agents because they are effective, because they leave no residue (i.e., they are liquids that evaporate completely or they are gases), and because they do not damage equipment or facilities to which they are applied.

Recently however, the halons have come to be recognized as serious environmental threats due to their ability to cause stratospheric ozone depletion. The ability of a compound to deplete stratospheric ozone is termed the "Ozone Depletion Potential" (ODP). Larger ODPs indicate greater stratospheric ozone depletion. ODPs reported for the halons are shown in Table I (Federal Register, Vol. 58, No. 250, 30 December 1991). Since ODPs are calculated and various models and input data are used, other values have been reported. The relatively high ODPs of the halons is due to two factors. (1) Bromine is a potent depleter of stratospheric ozone and is much more damaging to ozone than is chlorine. (2) Fluorine increases compound stability, greatly decreasing the amount of compound removal and breakdown in the troposphere and thus allowing most of any discharged halon to reach the stratosphere, where ozone destruction occurs. Due to stratospheric ozone depletion concerns, the Montreal Protocol, an international treaty prepared in 1987 and amended several times since, has required a halt in the production of Halon 1301, Halon 1211, and Halon 2402 at the end of 1993 in the United States and in other industrialized nations.

Much research has gone on to find replacements for the halons for protection against fires and explosions; however, the search for halon replacements has been less than totally successful ("Pressure Mounts As Search for Halon Replacements Reaches Critical Phase," *Chemical and Engineering News,* Sep. 19, 1994, pp. 29–32). One class of candidates proposed at one time as replacements of the halons were the hydrobromofluorocarbons (HBFCs), which contain only hydrogen, bromine, fluorine, and carbon. For example, bromodifluoromethane, $CHBrF_2$, is a highly effective HBFC fire suppressant and was commercialized for a short time as a halon replacement. Like the halons, however, the production of most HBFCs has now been banned in industrialized nations due to their significant ODP. None of the agents now being actively promoted as replacements for the halons contain bromine. The primary replacements are now hydrochlorofluorocarbons (HCFCs), hydrofluorocarbons (HFCs), and perfluorocarbons (PFCs or FCs). HCFCs, HFCs, and PFCs (FCs) appear to operate primarily by heat absorption, which is a less effective mechanism for most fire and explosion protection applications than the free-radical chain disruption mechanism believed to be effected by bromine and believed to be the primary mechanism for fire extinguishment by the halons. Thus, HCFCs, HFCs, and PFCs (a group of materials that we refer to as "first-generation" halon replacements) have a significantly decreased effectiveness in most fire and explosion protection applications compared to the halons that they are replacing.

Although bromine is believed to be the primary feature providing the outstanding fire extinguishment capability of the halons, it is precisely this feature that causes most (for Halon 1301 and Halon 2402, essentially all) of the stratospheric ozone depletion exhibited by these agents. Similarly, although fluorine-containing portions of the halon molecules may provide significant cooling and thereby enhance fire suppression by the bromine, it is precisely this portion of the chemicals that stabilizes the molecule and allows the halons to reach the stratosphere, where ozone depletion occurs. Thus, it is the combination of bromine and fluorine that both provides the outstanding fire extinguishment and produces the large ozone depletion exhibited by halons. Note, however, that it is the combination of bromine and fluorine in the same molecule that leads to large ozone depletion impacts. We have conceived, therefore, that one should be able to use a blend of two or more materials, none of which contain bromine and fluorine in the same molecule, to produce at a fire a mixture of bromine- and fluorine-containing fragments and bromine and fluorine atoms such as would be produced by the halons and by the HBFCs without the associated environmental impacts and regulatory restrictions. We have thus conceived blends of a bromine-containing component comprised of one or more halocarbons containing only bromine as the halogen and a fluorine-containing component comprised of one or more halocarbons containing only fluorine or only fluorine and chlorine as the halogens.

We first conceptualized the hydrobromoalkanes (compounds containing only hydrogen, bromine, and carbon) as constituents of the bromine-containing component. Of particular importance is whether such compounds would have sufficiently low ODPs to make them environmentally acceptable. The lightest member of the family of hydrobromoalkane chemicals, methyl bromide, has an unacceptably high ODP of 0.64 (*Scientific Assessment of Ozone Depletion:* 1994, Report No. 37, National Oceanic and Atmospheric Administration, National Aeronautics and Space Administration, United Nations Environment Programme, and World Meteorological Organization, February 1995) and is undergoing increasing restrictions due to ozone depletion concerns. We conceived, however, that hydrobromoalkanes with more hydrogen atoms and with more carbon-carbon bonds than methyl bromide should have lower ODPs and might not be environmentally harmful. For example, the atmospheric lifetimes of perfluorocarbons, which contain no hydrogen atoms, decreases from 50,000 years for carbon tetrafluoride ($CF_4$), which has no carbon-carbon bonds, to 10,000 years for hexafluoroethane ($CF_3CF_3$), with one carbon-carbon bond, to 2600 years for octafluoropropane ($CF_3CF_2CF_3$), with two carbon-carbon bonds (*Climate Change* 1995, *The Science of Climate Change,* J. T. Houghton, L. G. Meira Filho, B. A. Callander, N. Harris, A. Kattenberg, and K. Maskell, editors, Intergovernmental Panel on Climate Change, Cambridge University Press, Cambridge, UK, 1996.). Compounds that are rapidly removed from the atmosphere and, therefore, have a decreased atmospheric lifetime, will have a decreased impact on stratospheric ozone. Methyl bromide is the only hydrobromoalkane for which an ODP (or atmospheric lifetime) has been reported. To determine whether our concept was correct, we first used reported hydroxyl reaction rate constants to calculate atmospheric lifetimes for several hydrocarbons with increasing numbers of hydrogen atoms and carbon-carbon bonds. The results arc given in Table II. As we expected, the atmospheric lifetime decreases with increasing hydrogen content and carbon bonding. We then plotted the values in Table II and obtained a rather smooth curve (FIG. 1). What was surprising and was unexpected was that the atmospheric lifetime value for bromomethane, the only hydrobromoalkane for which an atmospheric lifetime has been reported, appears to lie on the extrapolated curve. We therefore postulated that hydrobromoalkanes having a single bromine atom, would all lie on or near the curve obtained for the simple hydrocarbons. For example, the 1-bromopropane, a hydrobromoalkane with seven hydrogen atoms and two carbon-carbon bonds, would be predicted to have an atmospheric lifetime of around 30 days. We have concluded from reported values for ODPs and atmospheric lifetimes that for bromine-containing compounds, the ODP increases by approximately 2 for each 10-year increase in atmospheric lifetime. Thus, with a predicted lifetime of about I month for bromopropane, one would predict an ODP of approximately 0.017. Bromobutanes containing a single bromine atom (e.g., 1-bromobutane, $CH_3CHBrCH_2CH_3$, and 2-bromobutane, $CH_3CHBrCH_2CH_3$), hydrobromoalkanes with nine hydrogen atoms and three carbon-carbon bonds, have predicted atmospheric lifetimes of approximately 7 days and ODP values of approximately 0.004. It should be noted that the atmospheric lifetimes may also decrease as the number of bromine atoms increases due to photolysis-decomposition by solar radiation, another, but often less efficient, atmospheric removal process. Thus, our investigation indicated that methyl bromide has an "anomalously" high ODP and that hydrobromoalkanes containing more hydrogen atoms and/or carbon-carbon bonds should be environmentally acceptable, as might such molecules with multiple bromine atoms.

TABLE II

TROPOSPHERIC HYDROXYL RATE CONSTANTS AND LIFETIMES CALCULATED FROM THOSE CONSTANTS FOR ALKANES.

| IUPAC name | Formula | Number of hydrogen atoms | Atmospheric lifetime, days |
|---|---|---|---|
| methane | $CH_4$ | 4 | 154 |
| ethane | $C_2H_6$ | 6 | 46.5 |
| propane | $C_3H_8$ | 8 | 9.49 |
| n-butane | $C_4H_{10}$ | 10 | 4.67 |

To determine whether our concept for a fire extinguishing agent was valid, we tested two blends of 1-bromopropane ($CH_2BrCH_2CH_3$, 10 percent and 25 percent by weight) as the bromine-containing component with a hydrofluoropolyether as the fluorine-containing component. The hydrofluoropolyether was a mixture of different molecular weight materials containing ether (C—O—C) linkages and hydrogen and fluorine substituents. The materials were tested using a cup burner apparatus and ii-heptane fuel ($C_7H_{16}$). For five determinations each, the average cup-burner extinguishment concentrations (with average deviations) were 3.18±0.05 volume percent in air for the 25 percent 1-bromopropane blend, 3.11±0.04 volume percent in air for the 10 percent blend, 5.23±0.10 volume percent in air for the hydrofluoropolyether by itself, and 4.63±0.23 volume percent in air for the 1-bromopropane by itself. A lower volume percent in air required for extinguishment indicates better performance. The results were surprising for three reasons. First, the blends were better than either of the two components separately. While we had hoped that this would be true, the magnitude of the improvement was unexpected. The average extinguishment concentrations for the two blends were approximately 40 percent lower than the extinguishment concentration for the hydrofluoropolyether by itself and approximately 32 percent lower than the extinguishment concentration obtained with 1-bromopropane by itself. Second, the extinguishment concentrations exhibited by the blends were very close to those obtained in separate studies for Halon 1301 and Halon 1211 (approximately 2.9 and 3.2 percent, respectively). This was entirely unexpected since it has proven extremely difficult to find halon replacement candidates with extinguishment concentrations as low as the halons. In fact, these cup burner extinguishment concentrations are better than those reported for any agents now being commercialized (*NFPA* 2001 *Standard on Clean Agent Fire Extinguishing Systems* 1996 *Edition* National Fire Protection Association, 1 Batterymarch Park, Quincy, Mass., 1996). Third, although the difference was small and lies within the data scatter, the blend containing 10 percent 1-bromopropane appeared to be slightly more effective than the blend containing 25 percent 1-bromopropane. One would expect that the performance should improve as the bromine concentration increased.

Field testing also indicated the surprising result that a lower concentration of 1-bromopropane gave improved performance. Thus, in streaming tests, a blend of 25 percent 1-bromopropane with 75 percent hydrofluoropolyether required a flow rate of 0.29 pounds/second to extinguish a 2.25-square foot heptane fire, whereas a blend of 10 percent 1-bromopropane with 90 percent hydrofluoropolyether required a flow rate of only 0.17 pounds/second. In these tests, a lower flow rate for extinguishment implies an improved performance. A flow rate of 0.38 pounds/second was required for extinguishment with the hydrofluoropolyether by itself. Again the effectiveness of the blends and the difference between the 10 percent 1-bromopropane and 25 percent 1-bromopropane blends was surprising and entirely unexpected.

Because of these unexpectedly good results, we looked for other families of compounds resembling the bromoalkanes in that they were composed only of bromine, hydrogen, and carbon. Hydrobromoalkenes and hydrobromoarenes meet the requirements and, moreover, have atmospheric lifetimes and ODPs even lower than those of the hydrobromoalkanes. The presence of multiple bonding in these unsaturated compounds provides additional reaction pathways for removal from the atmosphere. Thus, hydrobromoalkenes and hydrobromoarenes are unlikely to be regulated. We, therefore, conceived that hydrobromoalkenes and hydrobromoarenes could also be used in the bromine-containing components of the conceptualized blends. Some fluorine-containing bromoalkenes have been suggested for investigation as fire suppressants (W. M. Pitts, M. R. Nyden, R. G. Gann, W. G. Mallard, and W. Tsang, *Construction of an Exploratory List of Chemicals to Initiate The Search for Halon Alternatives,* NIST Technical Note 1279, Air Force Engineering and Services Laboratory, Tyndall Air Force Base, Florida, National Institute of Standards and Technology, Gaithersburg, Md., August 1990). Nonblended fluorine-containing bromoalkenes and nonblended fluorine-containing bromoarenes have been proposed as fire extinguishants (R. E. Tapscott, G. D. Brabson, G. W., Gobeli, E. W., Heinonen, J. A., Kaizerman, J. L., Lifke, and R. A. Patterson, "Research on Advanced Agents as Halon Replacements," *Proceedings, International Conference on Ozone Protection Technologies,* Washington, D.C., pp. 651–658, 21–23 October 1996; M. L. Robin, "Halogenated Fire Suppression Agents," in *Halon Replacements, Technology and Science,* ACS Symposium Series 611, Miziolek, A. W. and Tsang, W., editors, American Chemical Society, Washington, D.C., 9, pp. 85–98, 1995.) and cup burner flame extinguishment concentrations for some fluorinated bromoalkenes have been reported (Tapscott, R. E., and Mather, J. D., *Development of a Tropodegradable Total-Flooding Agent, Phase II: Initial Screening,* NMERI 96/22/30930, Advanced Agent Working Group, July 1997). In none of this art, however, were any alkenes or arenes containing no fluorine proposed as fire suppressants and no blends of these compounds were proposed, probably because the thinking up to now has been that fluorine is needed in the same compound as bromine in order to have a workable fire suppressant Although the purpose of the fluorine-containing component is to add fluorine to the blend reaching the fire to mimic the action of halons and HBFCs, there are side benefits. For example, the use of a nonflammable or a low-flammability fluorine-containing component may allow the use of normally flammable constituents in the bromine-containing component. Moreover, fluorine-containing components with appropriate physical properties may provide improvements in discharge and dispersion of bromine-containing materials having very high or very low boiling points. Compounds with very high boiling points may not disperse effectively to fill a space and compounds with very low boiling points may not discharge well in streaming applications. In addition, suitable fluorine-containing components can decrease toxicological concerns that may be associated with certain hydrobromocarbons by diluting the bromine-containing material. Our work also indicates that some blends possess flame extinguishment and suppression ability greater than would be predicted from the intrinsic fire suppression ability of the separate components, a phenomenon that we term "synergism."

Accordingly, it is an object of the present invention to provide effective fire extinguishing, fire suppression, explosion suppression, and explosion and fire inertion blends that contain two components.

SUMMARY OF THE INVENTION

This object is realized by providing a bromine-containing component comprised of one or more hydrobromocarbons, specifically the hydrobromoalkanes, hydrobromoalkenes, and hydrobromoarenes and a fluorine-containing component is comprised of one or more fluorine-containing halocarbons that contain no bromine and also no iodine.

The present invention therefore provides blends of hydrobromocarbons (specifically, hydrobromoalkanes, hydrobromoalkenes, and hydrobromoarenes) with halocarbons that always contain fluorine and, in some cases, also chlorine (but no bromine or iodine) for use as agents for fire extinguishing and suppression (in either total-flooding or streaming application), explosion suppression, and explosion and fire inertion. Note that in this application, "Blend" and "mixture" are used interchangeably.

In particular, the blend can be disposed, for example, in a pressurized discharge system and is adapted to be discharged into an area, for example to provide an average resulting concentration in such area of between 1–15%, and preferable 3–10% by gas volume, to extinguish or suppress a fire in that area. To suppress an explosion, a gas volume of 1–40% and preferably 5–20% is desired, while to prevent a fire or explosion from occurring, 1–30% and preferably 3–12% by gas volume is desired.

As the term is used in this application, hydrobromoalkanes are any compounds containing one or more bromine atoms and one or more hydrogen atoms attached to a linear, branched, or cyclic carbon chain or a combination of such chains and having no double bonds. Examples of such chains are shown below. Specifically excluded are the single-carbon compounds bromomethane, $CH_3Br$, which is known to cause environmental concerns, and dibromomethane ($CH_2Br_2$) and tribromomethane ($CHBr_3$), which have no carbon-carbon bonds and are predicted to have sufficiently long atmospheric lifetimes that they will have unacceptable ODPs.

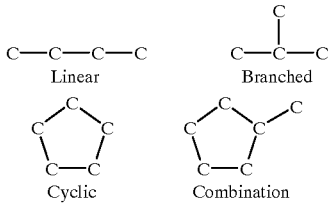

As the term is used in this application, hydrobromoalkenes are any compounds containing one or more bromine atoms and one or more hydrogen atoms attached to a linear, branched, or cyclic carbon chain or a combination of such chains having one or more double bonds. Examples of such chains are shown below.

Linear

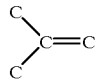
Branched

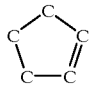
Cyclic

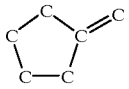
Combination

Linear With Two Double Bonds

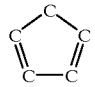
Cyclic With Two Double Bonds

As the term is used here, hydrobromoarenes contain bromine and hydrogen in a molecule that contains one or more "aromatic" rings of carbon atoms. The most common of these is the six-carbon benzene ring, which, formally, contains alternating single and double bonds. Actually, the double bonding is "delocalized" such that each bond is equivalent to 1½ bonds. Rings can also be joined to form additional aromatic compounds, and may contain alkyl groups. Alkyl groups are groups containing only carbon and hydrogen atoms such as methyl (—$CH_3$), ethyl (—$CH_2CH_3$), n-propyl (—$CH_2CH_2CH_3$), iso-propyl (—$CH(CH_3)_2$), and cyclo-butyl (—$C_4H_7$). The bromine atoms may be attached directly to the aromatic ring, to alkyl substituents, or to a combination of these. Examples of carbon chains in arenes, without the bromine or hydrogen substituents, are shown below.

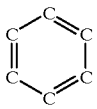
Benzene Ring

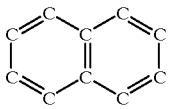
Two Fused Benzene Rings (Naphthalene Ring System)

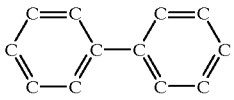
Two Attached Benzene Rings (Biphenyl Ring System)

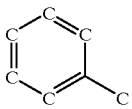
Alkyl-Substituted Benzene Ring

Hydrobromoalkanes

Hydrobromoalkanes include, by way of example only, the linear and branched monobromo compounds such as $CH_3CH_2Br$, $CH_3CH_2CH_2Br$, $CH_3CH_2CH_2CH_2Br$, $CH_3CHBrCH_3$, $CH_3CH(CH_3)CH_2Br$ and, in general, compounds having a formula $C_nH_{2n+1}Br$, where "n" is 2 or greater. Also disclosed here are the linear and branched dibromo compounds such as $CH_3CHBr_2$, $CH_2BrCH_2Br$, $CH_3CH_2CHBr_2$, $CH_3CHBrCH_2Br$, $CH_3CBr(CH_3)CH_2Br$ and, in general, compounds having a formula $C_nH_{2n}Br_2$, where "n" is 2 or greater. In general, the formulas of all of the linear and branched hydrobromoalkanes disclosed here have the formula $C_nH_{2n+2-x}Br_x$, where "n" is 2 or greater and "x" is at least 1, but not larger than 2n+1. A list of some linear and branched hydrobromoalkanes is shown in Table III.

TABLE III

SELECTED LINEAR AND BRANCHED HYDROBROMOALKANES.

| Formula | Name |
|---|---|
| $CH_3CH_2CH_2Br$ | 1-bromopropane |
| $CH_3CHBrCH_3$ | 2-bromopropane |
| $CH_3CH_2CH_2CH_2Br$ | 1-bromobutane |
| $CH_3CH_2CHBrCH_3$ | 2-bromobutane |
| $CH_3CH_2CH_2CH_2CH_2Br$ | 1-bromopentane |
| $CH_3CH_2CH_2CHBrCH_3$ | 2-bromopentane |
| $CH_3CH_2CHBrCH_2CH_3$ | 3-bromopentane |
| $CH_3CH_2CH_2CH_2CH_2CH_2Br$ | 1-bromohexane |
| $CH_3CH_2CH_2CH_2CHBrCH_3$ | 2-bromohexane |
| $CH_3CH_2CHBrCH_2CH_2CH_3$ | 3-bromohexane |
| $CH_3CH(CH_3)CH_2Br$ | 1-bromo-2-methylpropane |
| $CH_3C(CH_3)BrCH_3$ | 2-bromo-2-methylpropane |
| $CH_3CH_2CH(CH_3)CH_2Br$ | 1-bromo-2-methylbutane |
| $CH_3CH(CH_3)CH_2CH_2Br$ | 1-bromo-3-methylbutane |
| $CH_3CH_2CH_2CH(CH_3)CH_2Br$ | 1-bromo-2-methylpentane |
| $CH_3CH_2CH(CH_3)CH_2CH_2Br$ | 1-bromo-3-methylpentane |
| $CH_3CH(CH_3)CH_2CH_2CH_2Br$ | 1-bromo-4-methylpentane |
| $CH_3CHBr_2$ | 1,1-dibromoethane |
| $CH_2BrCH_2Br$ | 1,2-dibromoethane |
| $CH_3CH_2CHBr_2$ | 1,1-dibromopropane |
| $CH_3CHBrCH_2Br$ | 1,2-dibromopropane |
| $CH_2BrCH_2CH_2Br$ | 1,3-dibromopropane |

Hydrobromoalkanes also include cyclic compounds, which contain rings of carbon atoms. These include the cyclic monobromo compounds such as $C_3H_5Br$, $C_4H_7Br$, $C_5H_9Br$, $C_6H_{11}Br$, and, in general, cyclic compounds having a formula $C_nH_{2n-1}Br$; the cyclic dibromo compounds such as $C_3H_4Br_2$, $C_4H_6Br_2$, $C_5H_8Br_2$, $C_6H_{10}Br_2$, and, in general, cyclic compounds having a formula $C_nH_{2n-2}Br_2$; and more highly bromine-substituted cyclic bromocarbons. Cyclic hydrobromocarbons may also contain multiple rings. Thus, for example, a dibromo cyclic hydrobromoalkane containing two joined four-membered rings would have the formula $C_8H_{12}Br_2$. All of the cyclic hydrobromoalkanes disclosed here have the general formula $C_nH_{2n+2-2y-x}Br_x$, where "n" is 3 or greater, "x", is at least 1, but not larger than 2n+1−2y, and y is the number of rings. In general, hydrobromoalkanes containing more than one bromine atom can exist in more than one isomeric form. Example structures are shown below for cyclic hydrobromoalkanes.

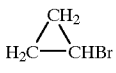
$C_3H_5Br$

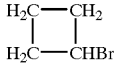
$C_4H_7Br$

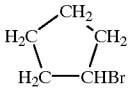
$C_5H_9Br$

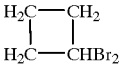

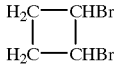

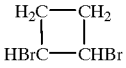

$C_4H_6Br_2$(3 Isomers Possible)

Hydrobromoalkanes also include cyclic compounds with alkyl substituents such as those shown below.

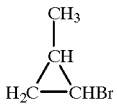

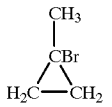

$C_3H_4Br(CH_3)$(2 Isomers Possible)

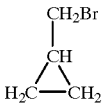

$C_3H_5(CH_2Br)$

-continued

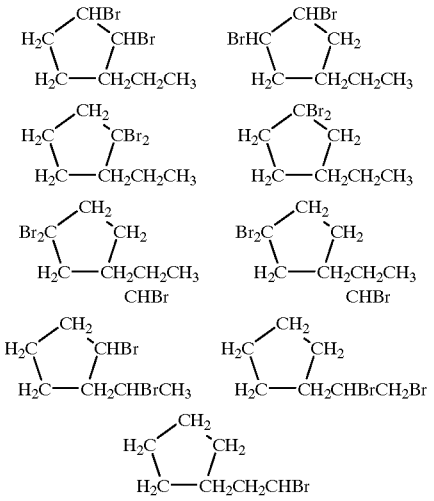

$C_7H_{13}Br_2$ (Many Isomers Possible)

Hydrobromoalkenes

Hydrobromoalkenes include the linear and branched compounds containing one carbon-carbon double bond, one or more hydrogen atoms, and one or more bromine atoms. Examples are $CH_2{=}CHBr$, $CH_2{=}CHCH_2Br$, $CH_2{=}CBrCH_3$, $CHBr{=}CHCH_3$, $CH_2{=}CBrCH_2Br$, $CHBr{=}C(CH_3)CH_3$, $CH_2{=}CHCHBr_2$), $CBr_2{=}C(CH_3)CH_2Br$, and, in general, hydrobromoalkenes having a formula $C_nH_{2n-x}Br_x$, where "n" is 2 or greater and "x" is 2n−1 or less but not less than one. They also include the linear and branched compounds containing two carbon-carbon double bonds and one or more bromine atoms $CH_2{=}CHCH{=}CHBr$, $CH_2{=}CHCBr{=}CH_2$, $CH_2{=}C(CH_3)CBr{=}CH_2$, $CH_2{=}C(CH_3)CBr{=}CHBr$, and, in general, hydrobromoalkenes having a formula $C_nH_{2n-2-x}Br_x$, where "n" is 3 or greater and "x" is 2n−1 or less but not less than one. Thus, in general, they include all linear and branched hydrobromoalkenes having one or more carbon-carbon double bonds and having the general formula $C_nH_{2n-2w+2-x}Br_x$, where "w" is the number of carbon-carbon double bonds, "n" is w+1 or greater, and "x" is 2n−2w+1 or less but not less than one.

Hydrobromoarenes

Hydrobromoarenes include, by way of example only, the monobromo compounds bromobenzene ($C_6H_5Br$), bromonaphthalene ($C_{10}H_7Br$, 2 isomers), and bromobiphenyl ($C_6H_5$—$C_6H_4Br$, 3 isomers); and the dibromo compounds dibromobenzene ($C_6H_4Br_2$, 3 isomers), dibromonaphthalene ($C_{10}H_6Br_2$, 6 isomers), and bromobiphenyl ($C_6H_5$—$C_6H_3Br_2$, 6 isomers, and $C_6H_4Br$—$C_6H_4Br$, 6 isomers); and brominated aromatics containing one or more hydrogen atoms and three or more bromine atoms.

Fluorine-Containing Component

A fluorine-containing component is added to the bromine-containing component to form the agent blends. The purpose of the fluorine-containing component is to produce an agent that resembles halons and HBFCs in fires. The fluorine-containing component may also aid to distribute the agent, modify the physical properties, reduce the toxicity, or to provide other benefits. The fluorine-containing component may be comprised of any organic compound containing fluorine or fluorine and chlorine but not containing any other halogen. Blends of the fluorine-containing component with hydrobromoalkanes, hydrobromoalkenes, and/or hydrobromoarenes may be either azeotropes, which do not change in composition as they evaporate, or zeotropes, which do change in composition during evaporation (more volatile components tend to evaporate preferentially). Mixtures that change only slightly in composition during evaporation are sometimes termed "near azeotropes." In some cases, there are advantages to azeotropes and near azeotropes. Mixtures covered by this application include azeotropes, near azeotropes, and zeotropes.

The fluorine-containing component is comprised of non-brominated halocarbons. The halocarbons can be such materials as hydrochlorofluorocarbons, hydrofluorocarbons, perfluorocarbons, perfluoroethers, hydrofluoroethers, hydrofluoropolyethers, and halogenated aromatics. Here, except for the aromatics, we use these terms to include both saturated and unsaturated hydrocarbons. Aromatics are always unsaturated. Hydrochlorofluorocarbons (HCFCs) are chemicals containing only hydrogen, chlorine, fluorine, and carbon. Examples of HCFCs that could be incorporated into the fluorine-containing component are 2,2-dichloro-1,1,1-trifluoroethane ($CHCl_2CF_3$), chlorodifluoromethane ($CHClF_2$), 2-chloro-1,1,1,2-tetrafluoroethane ($CHClFCF_3$), and 1-chloro- 1,1-difluoroethane ($CH_3CClF_2$). Hydrofluorocarbons (HFCs) are chemicals containing only hydrogen, fluorine, and carbon. Examples of potential HFCs that could be incorporated into the fluorine-containing component are trifluoromethane ($CHF_3$), difluoromethane ($CH_2F_2$), 1,1-difluoroethane ($CH_3CHF_2$), pentafluoroethane ($CHF_2CF_3$), 1,1,1,2-tetrafluoroethane ($CH_2FCF_3$), 1,1,1,2,2-pentafluoropropane ($CF_3CF_2CH_3$), 1,1,1,2,3,3-hexafluoropropane ($CF_3CHFCHF_2$), 1,1,1,3,3,3-hexafluoropropane ($CF_3CH_2CF_3$), 1,1,1,2,2,3,3-heptafluoropropane ($CF_3CF_2CF2H$), 1,1,1,2,3,3,3-heptafluoropropane ($CF_3CHFCF_3$), 1,1,1,4,4,4-hexafluorobutane ($CF_3CH_2CH_2CF_3$), and 1,1,1,2,2,3,4,5,5,5-decafluoropentane ($CF_3CHFCHFCF_2CF_3$). Perfluorocarbons contain only fluorine and carbon. The saturated PFCs are characterized by very low toxicities. Examples of saturated perfluorocarbons that could be incorporated into the fluorine-containing component are tetrafluoromethane ($CF_4$), hexafluoroethane ($CF_3CF_3$), octafluoropropane ($CF_3CF_2CF_3$), decafluorobutane ($CF_3CF_2CF_2CF_3$), dodecafluoropentane ($CF_3CF_2CF_2CF_2CF_3$), tetradecafluorohexane ($CF_3CF_2CF_2CF_2CF_2CF_3$), perfluoromethylcyclohexane ($C_6F_{11}CF_3$), perfluorodimethylcyclohexane ($C_6F_{10}(CF_3)_2$), and perfluoromethyldecalin ($C_{10}F_{17}CF_3$). Examples of unsaturated perfluorocarbons that could be incorporated into the fluorine-containing component are perfluoro-1-butene ($CF_2{=}CFCF_2CF_3$) and perfluoro-2-butene ($CF_3CF{=}CFCF_3$). Perfluoroethers are compounds containing only carbon, oxygen, and fluorine and possessing an ether linkage (C—O—C). Examples are perfluorodimethyl ether ($CF_3OCF_3$), perfluoromethylethylether ($CF_3CF_2OCF_3$), perfluoromethylpropyl ether ($CF_3OCF_2CF_2CF_3$), and perfluorodiethyl ether ($CF_3CF_2OCF_2CF_3$). Hydrofluoroethers contain an ether linkage and the elements hydrogen, fluorine, carbon, and oxygen. Examples are methyl perfluorobutyl ether ($CF_3CF_2CF_2CF_2OCH_3$), ethyl perfluorobutyl ether ($CF_3CF_2CF_2CF_2OC_2H_5$), bisdifluoromethyl ether ($CHF_2OCHF_2$), difluoromethyl 2,2,2-trifluoroethyl ether ($CF_3CH_2OCHF_2$), difluoromethyl 1,2,2,2-tetrafluoroethyl ether ($CHF_2OCHFCF_3$), methyl 1,1,2,2-tetrafluoroethyl ether ($CH_3OCF_2CHF_2$), methyl perfluoropropyl ether ($CH_3OCF_2CF_2CF_3$), methyl perfluoroisopropyl ether ($CH_3OCF(CF_3)_2$), 2,2,2-trifluoroethyl perfluoroethyl ether ($CF_3CH_2OCF_2CF_3$), and methyl perfluoroethyl ether ($CH_3OCF_2CF_3$). Hydrofluoropolyethers are polymeric liquids containing an ether linkage and the elements hydrogen, fluorine, carbon, and oxygen. Halogenated aromatics contain one or more 6-membered benzene rings. An example is chloropentafluorobenzene ($C_6F_5Cl$).

BRIEF DESCRIPTION OF THE DRAWING

FIG. 1 shows the atmospheric lifetime of certain compounds as a function of the number of hydrogen atoms.

DESCRIPTION OF SPECIFIC EMBODIMENTS

These and other aspects of the present invention will be more apparent upon consideration of the following examples.

As indicated previously, the present invention discloses the use of agents comprised of a bromine containing component and a fluorine containing component for the four applications of fire extinguishment or suppression using a total-flood application, fire extinguishment or suppression using a streaming application, explosion suppression, and inertion against fires and explosions. The bromine-containing component is comprised of one or more hydrobromocarbons selected from the group consisting of hydrobromoalkanes, hydrobromoalkenes, and hydrobromoarenes. The fluorine-containing component is comprised of one or more nonbrominated fluorine-containing halocarbons, which also contain no iodine. The following examples illustrate the fire and explosion protection in accordance with the invention.

Example 1. Into a flowing air stream in a cup burner apparatus in which a cup of burning n-heptane fuel was contained was introduced a mixture of 25 percent by weight 1-bromopropane ($CH_2BrCH_2CH_3$) and 75 percent by weight of a hydrofluoropolyether sufficient to raise the concentration of the blend in the air stream to 3.18 percent agent by gas volume. A second test was run with a mixture of 10 percent by weight 1-bromopropane and 90 percent by weight of a hydrofluoropolyether sufficient to raise the concentration of the blend in the air stream to 3.11 percent agent by gas volume. Both mixtures extinguished the fire. These extinguishment concentrations exhibited by the blends in air were less than the extinguishment concentration of Halon 1211 in air (3.2 percent) and only slightly higher than the extinguishment concentration of Halon 1301 in air (2.9 percent) under the same conditions. A third test was run with 100 percent 1-bromopropane sufficient to raise the concentration of the agent in the air stream to 4.63 percent agent by gas volume. Thus, extinguishment by 1-bromopropane by itself required a concentration 46 percent greater than that of the blend in the first test and 49 percent greater than that of the blend in the second test showing the improvement achieved by the addition of the fluorine-containing component.

Example 2. Into a flowing air stream in a cup burner apparatus in which a cup of burning n-heptane fuel was contained was introduced a mixture of 11.5 percent by weight 2,3-dibromopentane ($CH_3CHBrCHBrCH_2CH_3$) and 88.5 percent by weight of 1,1,1,3,3,3-hexafluoropropane ($CF_3CH_2CF_3$) sufficient to raise the concentration of the blend in the air stream to 3.66 percent agent by gas volume. The mixture extinguished the flame. The extinguishment concentration of this blend was 46 percent less than the average extinguishment concentration (seven determinations) of 6.72 percent agent by gas volume found for 1,1,1,3,3,3-hexafluoropropane ($CF_3CH_2CF_3$) alone under the same conditions showing the improvement achieved by the addition of the bromine-containing component.

Example 3. Into a flowing air stream in a cup burner apparatus in which a cup of burning n-heptane fuel was contained was introduced a mixture of 11.4 percent by weight 2,3-dibromobutane ($CH_3CHBrCHBrCH_3$) and 88.6 percent by weight of 1,1,1,3,3,3-hexafluoropropane ($CF_3CH_2CF_3$) sufficient to raise the concentration of the blend in the air stream to 4.64 percent agent by gas volume. The mixture extinguished the flame. The concentration in air required for extinguishment by this blend was 3 1 percent less than the average extinguishment concentration (seven determinations) of 6.72 percent agent by gas volume required to extinguish the fire with 1,1,1,3,3,3-hexafluoropropane ($CF_3CH_2CF_3$) alone.

Example 4. Onto a 2.25-square foot pan containing burning n-heptane fuel, a stream of a mixture of 25 percent by weight 1-bromopropane ($CH_2BrCH_2CH_3$) and 75 percent by weight of a hydrofluoropolyether was discharged using a flow rate of 0.29 pounds per second. The fire was extinguished in 2.6 seconds. In a second test using an identical apparatus, a mixture of 10 percent by weight 1-bromopropane and 90 percent by weight of a hydrofluoropolyether was discharged using a flow rate of 0.17 pounds per second. The fire was extinguished in 6 seconds.

Example 5. Onto a 2.25-square foot pan containing burning n-heptane fuel, a stream of a mixture of 25 percent by weight 1-bromopropane ($CH_2BrCH_2CH_3$) and 75 percent by weight of the hydrofluorocarbon 1,1,1,3,3,3-hexafluoropropane ($CF_3CH_2CF_3$) was discharged using a flow rate of 0.18 pounds per second. The fire was extinguished in 4.1 seconds.

Example 6. Into a well-ventilated 79.6-cubic foot test chamber containing an 8-inch diameter pan with a 1-inch deep pool of burning heptane was discharged 1.51 pounds of a blend of 15 percent 1-bromopropane ($CH_2BrCH_2CH_3$) and 85 percent by weight of a commercialized fire extinguishing agent NAF S-III, which is comprised of three HCFCs—chlorodifluoromethane ($CHClF_2$), 2-chloro-1,1,1,2-tetrafluoroethane ($CHClFCF_3$), and 2,2-dichloro-, 1,1,1-trifluoroethane ($CHCl_2CF_3$). The fire was extinguished in 5 seconds.

Example 7. An explosion occurs within a manufacturing facility used for filling aerosol cans with hydrocarbon propellants, and upon detection of the expanding fire ball, a blend of 20 percent by weight 3,3-dibromopropene ($CH_2{=}CHCHBr_2$) and 80 percent by weight decafluorobutane ($CF_3CF_2CF_2CF_3$) is automatically discharged and the explosion is suppressed.

Example 8. Upon detection of an unsafe concentration of methane in an enclosed room within a petroleum processing facility, a blend of 10 percent 1,1-dibromoethane ($CHBr_2CH_3$) and 90 percent perfluoro-1-butene ($CF_2{=}CFCF_2CF_3$) is discharged and the area is inerted to prevent an explosion or fire from occurring while the unsafe methane concentration condition is corrected.

The present invention has been described and illustrated with reference to certain preferred embodiments. Nevertheless, it will be understood that various modifications, alterations and substitutions may be apparent to one of ordinary skill in the art, and that such modifications, alterations and substitutions may be made without departing from the essential invention. Thus, the present invention is, of course, in no way restricted to the specific disclosure of the specification and examples, but also encompasses any modifications within the scope of the appended claims.

We claim:

1. A method of extinguishing or suppressing a fire in a total-flood application, said method comprising the steps of:

a) providing at least one hydrobromocarbon selected from the group consisting of hydrobromoalkanes and hydrobromoarenes, wherein said hydrobromocarbon has at least two carbon atoms and is present up to 25% by weight, b) mixing said at least one hydrobromocarbon with at least one halocarbon selected from the group consisting of all fluorine-containing halocarbons to give a blend, said halocarbons containing no bromine and no iodine, c) disposing said blend in a pressurized discharge system, and d) discharging said blend into an area to extinguish or suppress fires in that area.

2. The method of claim 1 wherein said at least one halocarbon is selected from the group consisting of saturated and unsaturated hydrochlorofluorocarbons, hydrofluorocarbons, perfluorocarbons, perfluoroethers, hydrofluoroethers, hydrofluoropolyethers and halogenated aromatics, and wherein said hydrobromoalkanes either have the formula $C_nH_{2n+2-x}Br_x$, where n is 2 or greater and x is at least 1 but not greater than 2n+1, or have the formula $C_nH_{2n+2-y-x}Br_x$, where n is 3 or greater, x is at least 1 but not greater than 2n+1−y, and y is the number of rings.

3. The method of claim 2 wherein said at least one hydrobromocarbon is selected from the group consisting of bromoethane ($CH_3CH_2Br$), 1-bromopropane ($CH_3CH_2CH_2Br$), 2-bromopropane ($CH_3CHBrCH_3$), 1-bromobutane ($CH_3CH_2CH_2CH_2Br$), 2-bromobutane ($CH_3CH_2CHBrCH_3$), 1-bromopentane ($CH_3CH_2CH_2CH_2CH_2Br$), 2-bromopentane ($CH_3CH_2CH_2CHBrCH_3$), 3-bromopentane ($CH_3CH_2CHBrCH_2CH_3$), 1-bromohexane ($CH_3CH_2CH_2CH_2CH_2CH_2Br$), 2-bromohexane ($CH_3CH_2CH_2CH_2CHBrCH_3$), 3-bromohexane ($CH_3CH_2CHBrCH_2CH_2CH_3$), 1-bromo-2-methylpropane ($CH_3CH(CH_3)CH_2Br$), 2-bromo-2-methylpropane ($CH_3C(CH_3)BrCH_3$), 1-bromo-2-methylbutane ($CH_3CH_2CH(CH_3)CH_2Br$), 1-bromo-3-methylbutane ($CH_3CH(CH_3)CH_2CH_2Br$), 1 -bromo-2-methylpentane ($CH_3CH_2CH_2CH(CH_3)CH_2Br$), 1 -bromo-3-methylpentane ($CH_3CH_2CH(CH_3)CH_2CH_2Br$), 1-bromo-4-methylpentane ($CH_3CH(CH_3)CH_2CH_2CH_2Br$), 1,1-dibromoethane ($CH_3CHBr_2$), 1,2-dibromoethane ($CH_2BrCH_2Br$), 1,1-dibromopropane ($CH_3CH_2CHBr_2$), 1,2-dibromopropane ($CH_3CHBrCH_2Br$), 1,3-dibromopropane ($CH_2BrCH_2CH_2Br$), bromocyclopropane ($C_3H_5Br$), bromocyclobutane ($C_4H_7Br$), bromocyclopentane ($C_5H_9Br$), and said at least one halocarbon is selected from the group consisting of 2,2-dichloro-1,1,1-trifluoroethane ($CHCl_2CF_3$), chlorodifluoromethane ($CHClF_2$), 2-chloro-1,1,1,2-tetrafluoroethane ($CHClFCF_3$), 1-chloro-1,1-difluoroethane ($CH_3CClF_2$), trifluoromethane ($CHF_3$), difluoromethane ($CH_2F_2$), 1,1-difluoroethane ($CH_3CHF_2$), pentafluoroethane ($CHF_2CF_3$), 1,1,1,2-tetrafluoroethane ($CH_2FCF_3$), 1,1,1,2,2-pentafluoropropane ($CF_3CF_2CH_3$), 1,1,1,2,3,3-hexafluoropropane ($CF_3CHFCHF_2$), 1,1,1,3,3,3-hexafluoropropane ($CF_3CH_2CF_3$), 1,1,1,2,2,3,3-heptafluoropropane ($CF_3CF_2CF_2H$), 1,1,1,2,3,3,3-heptafluoropropane ($CF_3CHFCF_3$), 1,1,1,4,4,4-hexafluorobutane ($CF_3CH_2CH_2CF_3$), 1,1,1,2,2,3,4,5,5,5-decafluoropentane ($CF_3CHFCHFCF_2CF_3$), tetrafluoromethane ($CF_4$), hexafluoroethane ($CF_3CF_3$), octafluoropropane ($CF_3CF_2CF_3$), decafluorobutane ($CF_3CF_2CF_2CF_3$), dodecafluoropentane ($CF_3CF_2CF_2CF_2CF_3$), tetradecafluorohexane ($CF_3CF_2CF_2CF_2CF_2CF_3$), perfluoromethylcyclohexane ($C_6F_{11}CF_3$), perfluorodimethylcyclohexane ($C_6F_{10}(CF_3)_2$), perfluoromethyldecalin ($C_{10}F_{17}CF_3$), perfluorodimethyl ether ($CF_3OCF_3$), perfluoromethylethylether ($CF_3CF_2OCF_3$), perfluoromethylpropyl ether ($CF_3OCF_2CF_2CF_3$), perfluorodiethyl ether ($CF_3CF_2OCF_2CF_3$), methyl perfluorobutyl ether ($CF_3CF_2CF_2CF_2OCH_3$), ethyl perfluorobutyl ether ($CF_3CF_2CF_2CF_2OC_2H_5$), bisdifluoromethyl ether ($CHF_2OCHF_2$), difluoromethyl 2,2,2-trifluoroethyl ether ($CF_3CH_2OCHF_2$), difluoromethyl 1,2,2,2-tetrafluoroethyl ether ($CHF_2OCHFCF_3$), methyl 1,1,2,2-tetrafluoroethyl ether ($CH_3OCF_2CHF_2$), methyl perfluoropropyl ether ($CH_3OCF_2CF_2CF_3$), methyl perfluoroisopropyl ether ($CH_3OCF(CF_3)_2$), 2,2,2-trifluoroethyl perfluoroethyl ether ($CF_3CH_2OCF_2CF_3$), methyl perfluoroethyl ether ($CH_3OCF_2CF_3$), perfluoro-1-butene ($CF_2{=}CFCF_2CF_3$), perfluoro-2-butene ($CF_3CF{=}CFCF_3$), and chloropentafluorobenzene ($C_6F_5Cl$).

4. A method of extinguishing or suppressing a fire in a streaming application, said method comprising the steps of:

a) providing at least one hydrobromocarbon selected from the group consisting of hydrobromoalkanes, and hydrobromoarenes, wherein said hydrobromocarbon has at least two carbon atoms and is present up to 25% by weight, b) mixing said at least one hydrobromocarbon with at least one halocarbon selected from the group consisting of all fluorine-containing halocarbons to give a blend, said halocarbons containing no bromine and no iodine, b) disposing said blend in a pressurized discharge system, and c) discharging said blend from said system toward an existing fire to suppress or extinguish said fire.

5. The method of claim 4 wherein said at least one halocarbon is selected from the group consisting of saturated and unsaturated hydrochlorofluorocarbons, hydrofluorocarbons, perfluorocarbons, perfluoroethers, hydrofluoroethers, hydrofluoropolyethers and halogenated aromatics, and wherein said hydrobromoalkanes either have the formula $C_nH_{2n+2-x}Br_x$, where n is 2 or greater and x is at least 1 but not greater than 2n+1, or have the formula $C_nH_{2n+2-y-x}Br_x$, where n is 3 or greater, x is at least 1 but not greater than 2n+1−y, and y is the number of rings.

6. The method of claim 5 wherein said at least one hydrobromocarbon is selected from the group consisting of bromoethane ($CH_3CH_2Br$), 1-bromopropane ($CH_3CH_2CH_2Br$), 2-bromopropane ($CH_3CHBrCH_3$), 1-bromobutane ($CH_3CH_2CH_2CH_2Br$), 2-bromobutane ($CH_3CH_2CHBrCH_3$), 1-bromopentane ($CH_3CH_2CH_2CH_2CH_2Br$), 2-bromopentane ($CH_3CH_2CH_2CHBrCH_3$), 3-bromopentane ($CH_3CH_2CHBrCH_2CH_3$), 1-bromohexane ($CH_3CH_2CH_2CH_2CH_2CH_2Br$), 2-bromohexane ($CH_3CH_2CH_2CH_2CHBrCH_3$), 3-bromohexane ($CH_3CH_2CHBrCH_2CH_2CH_3$), 1-bromo-2-methylpropane ($CH_3CH(CH_3)CH_2Br$), 2-bromo-2-methylpropane ($CH_3C(CH_3)BrCH_3$), 1-bromo-2-methylbutane ($CH_3CH_2CH(CH_3)CH_2Br$), 1-bromo-3-methylbutane ($CH_3CH(CH_3)CH_2CH_2Br$), 1-bromo-2-methylpentane ($CH_3CH_2CH_2CH(CH_3)CH_2Br$), 1-bromo-3-methylpentane ($CH_3CH_2CH(CH_3)CH_2CH_2Br$), 1-bromo-4-methylpentane ($CH_3CH(CH_3)CH_2CH_2CH_2Br$), 1,1-dibromoethane ($CH_3CHBr_2$), 1,2-dibromoethane ($CH_2BrCH_2Br$), 1-dibromopropane ($CH_3CH_2CHBr_2$), 1,2-dibromopropane ($CH_3CHBrCH_2Br$), 1,3-dibromopropane ($CH_2BrCH_2CH_2Br$), bromocyclopropane ($C_3H_5Br$), bromocyclobutane ($C_4H_7Br$), bromocyclopentane ($C_5H_9Br$), and said at least one halocarbon is selected from the group consisting of 2,2-dichloro-1,1,1-trifluoroethane ($CHCl_2CF_3$), chlorodifluoromethane ($CHClF_2$), 2-chloro-1,1,1,2-tetrafluoroethane ($CHClFCF_3$), 1-chloro-1,1-difluoroethane ($CH_3CClF_2$), trifluoromethane ($CHF_3$), difluoromethane ($CH_2F_2$), 1,1-difluoroethane ($CH_3CHF_2$), pentafluoroethane ($CHF_2CF_3$), 1,1,1,2-tetrafluoroethane ($CH_2FCF_3$), 1,1,1,2,2-pentafluoropropane ($CF_3CF_2CH_3$), 1,1,1,2,3,3-hexafluoropropane ($CF_3CHFCHF_2$), 1,1,1,3,3,3-hexafluoropropane ($CF_3CH_2CF_3$), 1,1,1,2,2,3,3-heptafluoropropane ($CF_3CF_2CF_2H$), 1,1,1,2,3,3,3-heptafluoropropane ($CF_3CHFCF_3$), 1,1,1,4,4,4-hexafluorobutane ($CF_3CH_2CH_2CF_3$), 1,1,1,2,2,3,4,5,5,5-decafluoropentane ($CF_3CHFCHFCF_2CF_3$), tetrafluoromethane ($CF_4$), hexafluoroethane ($CF_3CF_3$), octafluoropropane ($CF_3CF_2CF_3$), decafluorobutane ($CF_3CF_2CF_2CF_3$), dodecafluoropentane ($CF_3CF_2CF_2CF_2CF_3$), tetradecafluorohexane ($CF_3CF_2CF_2CF_2CF_2CF_3$), perfluoromethylcyclohexane ($C_6F_{11}CF_3$), perfluorodimethylcyclohexane ($C_6F_{10}(CF_3)_2$), perfluoromethyldecalin ($C_{10}F_{17}CF_3$), perfluorodimethyl ether ($CF_3OCF_3$), perfluoromethylethylether ($CF_3CF_2OCF_3$), perfluoromethylpropyl ether ($CF_3OCF_2CF_2CF_3$), perfluorodiethyl ether ($CF_3CF_2OCF_2CF_3$), methyl perfluorobutyl ether ($CF_3CF_2CF_2CF_2OCH_3$), ethyl perfluorobutyl ether ($CF_3CF_2CF_2CF_2OC_2H_5$), bisdifluoromethyl ether ($CHF_2OCHF_2$), difluoromethyl 2,2,2-trifluoroethyl ether ($CF_3CH_2OCHF_2$), difluoromethyl 1,2,2,2-tetrafluoroethyl ether ($CHF_2OCHFCF_3$), methyl 1,1,2,2-tetrafluoroethyl ether ($CH_3OCF_2CHF_2$), methyl perfluoropropyl ether ($CH_3OCF_2CF_2CF_3$), methyl perfluoroisopropyl ether ($CH_3OCF(CF_3)_2$), 2,2,2-trifluoroethyl perfluoroethyl ether ($CF_3CH_2OCF_2CF_3$), methyl perfluoroethyl ether ($CH_3OCF_2CF_3$), perfluoro-1-butene ($CF_2{=}CFCF_2CF_3$), perfluoro-2-butene ($CF_3CF{=}CFCF_3$), and chloropentafluorobenzene ($C_6F_5Cl$).

7. A method of suppressing an explosion, said method comprising the steps of a) providing at least one hydrobromocarbon selected from the group consisting of hydrobromoalkanes and hydrobromoarenes, wherein said hydrobromocarbon has at least two carbon atoms and is present up to 25% by weight, b) mixing said at least one hydrobromocarbon with at least one halocarbon selected from the group consisting of all fluorine-containing nonbrominated halocarbons to give a blend, said halocarbons containing no bromine and no iodine, c) detecting an explosion and discharging said blend into the area of the explosion to suppress the explosion.

8. The method of claim 7 wherein said at least one halocarbon is selected from the group consisting of saturated and unsaturated hydrochlorofluorocarbons, hydrofluorocarbons, perfluorocarbons, perfluoroethers, hydrofluoroethers, hydrofluoropolyethers and halogenated aromatics, and wherein said hydrobromoalkanes either have the formula $C_nH_{2n+2-y-x}$, where n is 2 or greater and x is at least 1 but not greater than 2n+1, or have the formula $C_nH_{2n+2-y-x}Br_x$, where n is 3 or greater, x is at least 1 but not greater than 2n+1-y, and y is the number of rings.

9. The method of claim 8 wherein said at least one hydrobromocarbon is selected from the group consisting of bromoethane ($CH_3CH_2Br$), 1-bromopropane ($CH_3CH_2CH_2Br$), 2-bromopropane ($CH_3CHBrCH_3$), 1-bromobutane ($CH_3CH_2CH_2CH_2Br$), 2-bromobutane ($CH_3CH_2CHBrCH_3$), 1-bromopentane ($CH_3CH_2CH_2CH_2CH_2Br$), 2-bromopentane ($CH_3CH_2CH_2CHBrCH_3$), 3-bromopentane ($CH_3CH_2CHBrCH_2CH_3$), 1-bromohexane ($CH_3CH_2CH_2CH_2CH_2CH_2Br$), 2-bromohexane ($CH_3CH_2CH_2CH_2CHBrCH_3$), 3-bromohexane ($CH_3CH_2CHBrCH_2CH_2CH_3$), 1-bromo-2-methylpropane ($CH_3CH(CH_3)CH_2Br$), 2-bromo-2-methylpropane ($CH_3C(CH_3)BrCH_3$), 1-bromo-2-methylbutane ($CH_3CH_2CH(CH_3)CH_2Br$), 1-bromo-3-methylbutane ($CH_3CH(CH_3)CH_2CH_2Br$), 1-bromo-2-methylpentane ($CH_3CH_2CH_2CH(CH_3)CH_2Br$), 1-bromo-3-methylpentane ($CH_3CH_2CH(CH_3)CH_2CH_2Br$), 1-bromo-4-methylpentane ($CH_3CH(CH_3)CH_2CH_2CH_2Br$), 1,1-dibromoethane ($CH_3CHBr_2$), 1,2-dibromoethane ($CH_2BrCH_2Br$), 1,1-dibromopropane ($CH_3CH_2CHBr_2$), 1,2-dibromopropane ($CH_3CHBrCH_2Br$), 1,3-dibromopropane ($CH_2BrCH_2CH_2Br$), bromocyclopropane ($C_3H_5Br$), bromocyclobutane ($C_4H_7Br$), bromocyclopentane ($C_5H_9Br$), and said at least one halocarbon is selected from the group consisting of 2,2-dichloro-1,1,1-trifluoroethane ($CHCl_2CF_3$), chlorodifluoromethane ($CHClF_2$), 2-chloro-1,1,1,2-tetrafluoroethane ($CHClFCF_3$), 1-chloro-1,1-difluoroethane ($CH_3CClF_2$), trifluoromethane ($CHF_3$), difluoromethane ($CH_2F_2$), 1,1-difluoroethane ($CH_3CHF_2$), pentafluoroethane ($CHF_2CF_3$), 1,1,1,2-tetrafluoroethane ($CH_2FCF_3$), 1,1,1,2,2-pentafluoropropane ($CF_3CF_2CH_3$), 1,1,1,2,3,3-hexafluoropropane ($CF_3CHFCHF_2$), 1,1,1,3,3,3-hexafluoropropane ($CF_3CH_2CF_3$), 1,1,1,2,2,3,3-heptafluoropropane ($CF_3CF_2CF_2H$), 1,1,1,2,3,3,3-heptafluoropropane ($CF_3CHFCF_3$), 1,1,1,4,4,4-hexafluorobutane ($CF_3CH_2CH_2CF_3$), 1,1,1,2,2,3,4,5,5,5-decafluoropentane ($CF_3CHFCHFCF_2CF_3$), tetrafluoromethane ($CF_4$), hexafluoroethane ($CF_3CF_3$), octafluoropropane ($CF_3CF_2CF_3$), decafluorobutane ($CF_3CF_2CF_2CF_3$), dodecafluoropentane ($CF_3CF_2CF_2CF_2CF_3$), tetradecafluorohexane ($CF_3CF_2CF_2CF_2CF_2CF_3$), perfluoromethylcyclohexane ($C_6F_{11}CF_3$), perfluorodimethylcyclohexane ($C_6F_{10}(CF_3)_2$), perfluoromethyldecalin ($C_{10}F_{17}CF_3$), perfluorodimethyl ether ($CF_3OCF_3$), perfluoromethylethylether ($CF_3CF_2OCF_3$), perfluoromethylpropyl ether ($CF_3OCF_2CF_2CF_3$), perfluorodiethyl ether ($CF_3CF_2OCF_2CF_3$), methyl perfluorobutyl ether ($CF_3CF_2CF_2CF_2OCH_3$), ethyl perfluorobutyl ether ($CF_3CF_2CF_2CF_2OC_2H_5$), bisdifluoromethyl ether ($CHF_2OCHF_2$), difluoromethyl 2,2,2-trifluoroethyl ether ($CF_3CH_2OCHF_2$), difluoromethyl 1,2,2,2-tetrafluoroethyl ether ($CHF_2OCHFCF_3$), methyl 1,1,2,2-tetrafluoroethyl ether ($CH_3OCF_2CHF_2$), methyl perfluoropropyl ether ($CH_3OCF_2CF_2CF_3$), methyl perfluoroisopropyl ether ($CH_3OCF(CF_3)_2$), 2,2,2-trifluoroethyl perfluoroethyl ether ($CF_3CH_2OCF_2CF_3$), methyl perfluoroethyl ether ($CH_3OCF_2CF_3$), perfluoro-1-butene ($CF_2{=}CFCF_2CF_3$), perfluoro-2-butene ($CF_3CF{=}CFCF_3$), and chloropentafluorobenzene ($C_6F_5Cl$).

10. A method of inerting an area to prevent a fire or explosion, said method comprising the steps of:

a) providing at least one hydrobromocarbon selected from the group consisting of hydrobromoalkanes and hydrobromoarenes, wherein said hydrobromocarbon has at least two carbon atoms and is present up to 25% by weight.

b) mixing said at least one hydrobromocarbon with at least one halocarbon selected from the group consisting of all fluorine-containing nonbrominated halocarbons to give a blend, said halocarbon containing no bromine and no iodine, c) disposing said blend in a pressurized discharge system, and d) discharging said agent into said area to prevent a fire or an explosion from occurring.

11. The method of claim 10 wherein said at least one halocarbon is selected from the group consisting of saturated and unsaturated hydrochlorofluorocarbons, hydrofluorocarbons, perfluorocarbons, perfluoroethers, hydrofluoroethers, hydrofluoropolyethers and halogenated aromatics, and wherein said hydrobromoalkanes either have the formula $C_nH_{2n+2-x}Br_x$, where n is 2 or greater and x is at least 1 but not greater than 2n+1, or have the formula $C_nH_{2n+2-y-x}Br_x$, where n is 3 or greater, x is at least 1 but not greater than 2n+1-y, and y is the number of rings.

12. The method of claim 11 wherein said at least one hydrobromocarbon is selected from the group consisting of bromoethane ($CH_3CH_2Br$), 1-bromopropane ($CH_3CH_2CH_2Br$), 2-bromopropane ($CH_3CHBrCH_3$), 1-bromobutane ($CH_3CH_2CH_2CH_2Br$), 2-bromobutane ($CH_3CH_2CHBrCH_3$), 1-bromopentane ($CH_3CH_2CH_2CH_2CH_2Br$), 2-bromopentane ($CH_3CH_2CH_2CHBrCH_3$), 3-bromopentane ($CH_3CH_2CHBrCH_2CH_3$), 1-bromohexane ($CH_3CH_2CH_2CH_2CH_2CH_2Br$), 2-bromohexane ($CH_3CH_2CH_2CH_2CHBrCH_3$), 3-bromohexane ($CH_3CH_2CHBrCH_2CH_2CH_3$), 1-bromo-2-methylpropane ($CH_3CH(CH_3)CH_2Br$), 2-bromo-2-methylpropane ($CH_3C(CH_3)BrCH_3$), 1-bromo-2-methylbutane ($CH_3CH_2CH(CH_3)CH_2Br$), 1-bromo-3-methylbutane ($CH_3CH(CH_3)CH_2CH_2Br$), 1 -bromo-2-methylpentane ($CH_3CH_2CH_2CH(CH_3)CH_2Br$), 1 -bromo-3-methylpentane ($CH_3CH_2CH(CH_3)CH_2CH_2Br$), 1-bromo-4-methylpentane ($CH_3CH(CH_3)CH_2CH_2CH_2Br$), 1,1-dibromoethane ($CH_3CHBr_2$), 1,2-dibromoethane ($CH_2BrCH_2Br$), 1,1-dibromopropane ($CH_3CH_2CHBr_2$), 1,2-dibromopropane ($CH_3CHBrCH_2Br$), 1,3-dibromopropane ($CH_2BrCH_2CH_2Br$), bromocyclopropane ($C_3H_5Br$), bromocyclobutane ($C_4H_7Br$), bromocyclopentane ($C_5H_9Br$), and said at least one halocarbon is selected from the group consisting of 2,2-dichloro-1,1,1-trifluoroethane ($CHCl_2CF_3$), chlorodifluoromethane ($CHClF_2$), 2-chloro-1,1,1,2-tetrafluoroethane ($CHClFCF_3$), 1-chloro-1,1-difluoroethane ($CH_3CClF_2$), trifluoromethane ($CHF_3$), difluoromethane ($CH_2F_2$), 1,1-difluoroethane ($CH_3CHF_2$), pentafluoroethane ($CHF_2CF_3$), 1,1,1,2-tetrafluoroethane ($CH_2FCF_3$), 1,1,1,2,2-pentafluoropropane ($CF_3CF_2CH_3$), 1,1,1,2,3,3-hexafluoropropane ($CF_3CHFCHF_2$), 1,1,1,3,3,3-hexafluoropropane ($CF_3CH_2CF_3$), 1,1,1,2,2,3,3-heptafluoropropane ($CF_3CF_2CF_2H$), 1,1,1,2,3,3,3-heptafluoropropane ($CF_3CHFCF_3$), 1,1,1,4,4,4-hexafluorobutane ($CF_3CH_2CH_2CF_3$), 1,1,1,2,2,3,4,5,5,5-decafluoropentane ($CF_3CHFCHFCF_2CF_3$), tetrafluoromethane ($CF_4$), hexafluoroethane ($CF_3CF_3$), octafluoropropane ($CF_3CF_2CF_3$), decafluorobutane ($CF_3CF_2CF_2CF_3$), dodecafluoropentane ($CF_3CF_2CF_2CF_2CF_3$), tetradecafluorohexane ($CF_3CF_2CF_2CF_2CF_2CF_3$), perfluoromethylcyclohexane ($C_6F_{11}CF_3$), perfluorodimethylcyclohexane ($C_6F_{10}(CF_3)_2$), perfluoromethyldecalin ($C_{10}F_{17}CF_3$), perfluorodimethyl ether ($CF_3OCF_3$), perfluoromethylethylether ($CF_3CF_2OCF_3$), perfluoromethylpropyl ether ($CF_3OCF_2CF_2CF_3$), perfluorodiethyl ether ($CF_3CF_2OCF_2CF_3$), methyl perfluorobutyl ether ($CF_3CF_2CF_2CF_2OCH_3$), ethyl perfluorobutyl ether ($CF_3CF_2CF_2CF_2OC_2H_5$), bisdifluoromethyl ether ($CHF_2OCHF_2$), difluoromethyl 2,2,2-trifluoroethyl ether ($CF_3CH_2OCHF_2$), difluoromethyl 1,2,2,2-tetrafluoroethyl ether ($CHF_2OCHFCF_3$), methyl 1,1,2,2-tetrafluoroethyl ether ($CH_3OCF_2CHF_2$), methyl perfluoropropyl ether ($CH_3OCF_2CF_2CF_3$), methyl perfluoroisopropyl ether ($CH_3OCF(CF_3)_2$), 2,2,2-trifluoroethyl perfluoroethyl ether ($CF_3CH_2OCF_2CF_3$), methyl perfluoroethyl ether ($CH_3OCF_2CF_3$), perfluoro-1-butene ($CF_2{=}CFCF_2CF_3$), perfluoro-2-butene ($CF_3CF{=}CFCF_3$), and chloropentafluorobenzene ($C_6F_5Cl$).

* * * * *